US011057697B2

(12) United States Patent
Ikeda

(10) Patent No.: US 11,057,697 B2
(45) Date of Patent: Jul. 6, 2021

(54) WEARABLE SPEAKER SYSTEM

(71) Applicant: SHARP KABUSHIKI KAISHA, Sakai (JP)

(72) Inventor: Takeshi Ikeda, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/797,715

(22) Filed: Feb. 21, 2020

(65) Prior Publication Data

US 2020/0275193 A1 Aug. 27, 2020

(30) Foreign Application Priority Data

Feb. 21, 2019 (JP) ..... JP2019-029570

(51) Int. Cl.
*H04R 1/28* (2006.01)
*H04R 1/02* (2006.01)

(52) U.S. Cl.
CPC ..... *H04R 1/2826* (2013.01); *H04R 1/025* (2013.01); *H04R 1/288* (2013.01)

(58) Field of Classification Search
CPC ..... H04R 1/2826; H04R 1/025; H04R 1/288
See application file for complete search history.

(56) References Cited

U.S. PATENT DOCUMENTS 4,539,440 A * 9/1985 Sciarra ..... H04R 25/656 381/321
2003/0065244 A1* 4/2003 Kasic, II ..... A61L 27/30 600/25
2004/0146172 A1* 7/2004 Goswami ..... H04R 5/033 381/378
2008/0000715 A1* 1/2008 Bouvier ..... H04R 1/345 181/156
2020/0100004 A1* 3/2020 Minoda ..... H04R 1/22

FOREIGN PATENT DOCUMENTS

JP 2018-148479 A 9/2018
JP 2018-148480 A 9/2018

* cited by examiner

*Primary Examiner* — Mark Fischer
(74) *Attorney, Agent, or Firm* — ScienBiziP, P.O.

(57) ABSTRACT

A wearable speaker system includes a bellows tube that holds a weight inside, and a speaker unit where a space inside the speaker unit and a space inside the bellows tube communicate with each other. The bellows tube is accommodated in the enclosure, and both end portions of the bellows tube are fixed to the enclosure.

5 Claims, 11 Drawing Sheets

WEARABLE SPEAKER SYSTEM

BACKGROUND

1. Field

The present disclosure relates to a wearable speaker system provided with an enclosure.

2. Description of the Related Art

There are cases where large-diameter speakers and headphones are used in speaker systems to obtain a feeling of presence. However, speaker systems having large-diameter speakers take up a considerable amount of space. Also, headphones are used in a state where the headphones press the ears of the user inwards, so usage for a long period of time gives the user a feeling of fatigue.

Now, Japanese Unexamined Patent Application Publication No. 2018-148479 and No. 2018-148480 (both published Sep. 20, 2018) describe wearable speaker systems that are worn on the body of the user and do not block the ears of the user. For example, Japanese Unexamined Patent Application Publication No. 2018-148479 describes a wearable speaker system that has a U-shaped enclosure, and opening portions are provided to the enclosure at end portions of bass reflex ducts. Also, Japanese Unexamined Patent Application Publication No. 2018-148480 describes a wearable speaker system that is configured including a speaker unit and a bellows tube, where spaces inside the speaker unit and the bellows tube communicate with each other.

However, the above-described related art has the following problem. In the technique disclosed in Japanese Unexamined Patent Application Publication No. 2018-148480, the bellows tube is exposed and serves as an enclosure, and accordingly may come into contact with some external object. If some external object comes into contact with the bellows tube, the vibration characteristics will change.

It is desirable to realize a wearable speaker system that has a bellows tube and where change in vibration characteristics due to external influence is suppressed.

SUMMARY

According to an aspect of the disclosure, there is provided a wearable speaker system provided with an enclosure, the wearable speaker system including a bellows tube that holds a weight member inside, and a speaker unit where a space inside the speaker unit and a space inside the bellows tube communicate with each other. The bellows tube is accommodated in the enclosure, and both end portions of the bellows tube are fixed to the enclosure.

BRIEF DESCRIPTION OF THE DRAWINGS

FIG. 1A is a frontal view of the wearable speaker system, and FIG. 1B is a perspective view;

FIG. 6A is a view of the outer face of the enclosure, FIG. 6B is a diagram illustrating the inside of the enclosure, and FIG. 6C is a diagram illustrating the inside of the enclosure in a state where a bellows tube is removed;

FIG. 8A is a side view and FIG. 8B is a perspective view;

FIG. 9A is a diagram illustrating an example of inserting the bass reflex duct into the bellows tube from a correct direction, and FIG. 9B is a diagram illustrating an example of inserting the bass reflex duct into the bellows tube from an incorrect direction;

FIG. 11A is a side view illustrating a state where the bass reflex duct with the weight attached is inserted into the bellows tube, and FIG. 11B is an enlarged view of a region XIB in FIG. 11A in a state where the weight is removed.

DESCRIPTION OF THE EMBODIMENTS

Overall Configuration of Wearable Speaker System 100

Figure 1A:
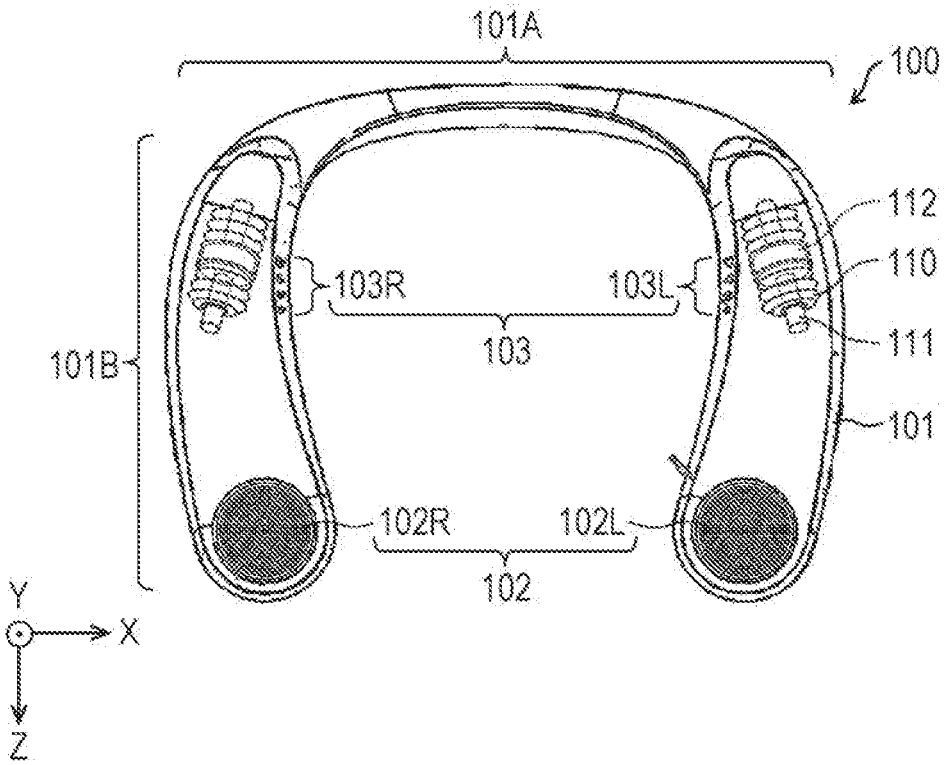
FIGS. 1A and 1B are diagrams illustrating an overview of a wearable speaker system according to an embodiment of the present disclosure, where
Figure 1B:
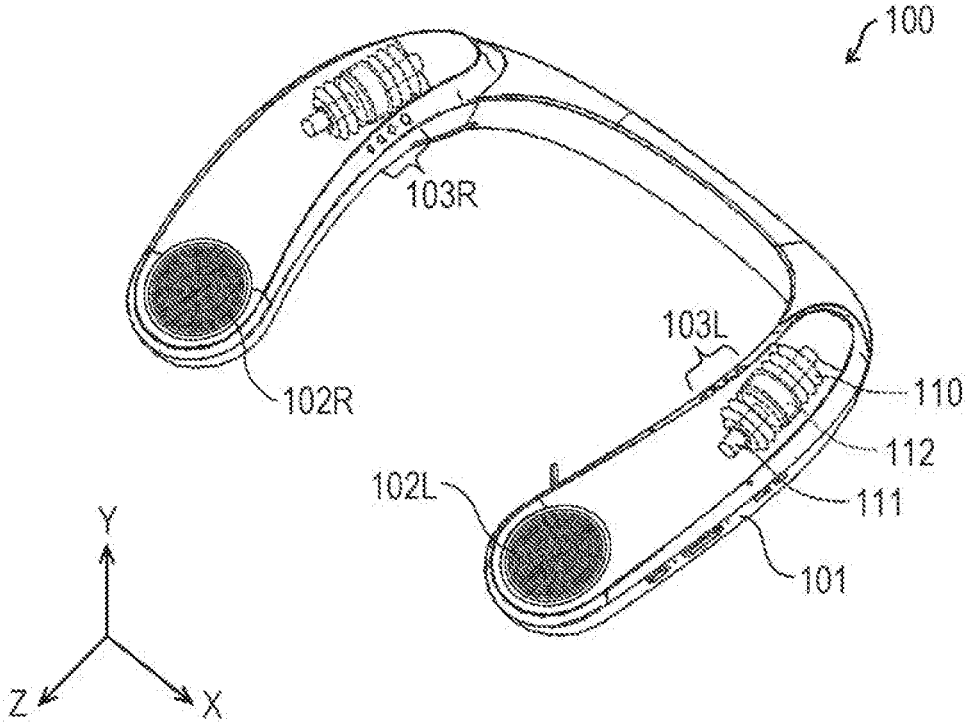

An embodiment of the present disclosure will be described below in detail. First, an overview of a wearable speaker system 100 according to the present embodiment will be described with reference to FIGS. 1A and 1B. FIGS. 1A and 1B are diagrams illustrating an overview of the wearable speaker system 100, where FIG. 1A is a frontal view of the wearable speaker system 100, and FIG. 1B is a perspective view. Note that bellows tubes 110, bass reflex ducts (duct tubes) ill, and weights (weight members) 112 illustrated in FIGS. 1A and 1B are accommodated inside an enclosure 101 and are not externally visible, and accordingly are illustrated by dashed lines.

Note that in the present embodiment, a direction in which sound is output from a speaker unit 102 in the wearable speaker system 100 i.e., a direction heading toward the ears of the user when in use will be referred to as "Y direction", a direction from a right speaker (speaker unit 102R) of the speaker unit 102 toward a left speaker (speaker unit 102L) will be referred to as "X direction", and a direction orthogonal to the X direction and Y direction will be referred to as "Z direction". The face of the wearable speaker system 100 when viewed from the Y direction toward the −Y direction will be referred to as "front".

The wearable speaker system 100 is provided with the enclosure 101, as illustrated in FIGS. 1A and 1B. The enclosure 101 is generally U-shaped as viewed from the front. The shape of the enclosure 101 as viewed from the front can also be expressed as "horseshoe shape", "reverse U-shape", and so forth. The enclosure 101 includes a portion (nape portion 101A) that extends in the ±X direction from the middle of enclosure 101 and also extends somewhat in the Z direction, and portions (neck-side portions 101B) that each extend in the Z direction from the end portions of the nape portion 101A.

The nape portion 101A is made of a material that has flexibility. The nape portion 101A bends somewhat when being worn by the user, and thus the wearable speaker system 100 can be easily mounted around the neck of the user. On the other hand, the neck-side portions 101B are made of a material that is harder than the nape portion 101A.

The speaker unit 102 is provided at the end portion of the enclosure 101. Note that the side that corresponds to the right ear of the user when in use will be referred to as "speaker unit 102R", and the side that corresponds to the left ear of the user when in use will be referred to as "speaker unit 102L". Unless distinguishing between the two is relevant, these will be referred to simply as "speaker unit 102".

The speaker unit 102 can be realized by known technique, and according detailed description will be omitted. The speaker unit 102 has speakers that have openings toward the Y direction, and the speakers include a frame, magnetic circuit, diaphragm, and so forth, that are omitted from illustration.

Opening portions 103 are openings provided to the enclosure 101. Four opening portions 103, which are each circular in shape, are provided along the enclosure 101 on the inner-side side faces of the neck-side portions 101B of the enclosure 101 in the present embodiment. The radii of the circles are larger the closer to the nape portion 101A. The opening portions 103 are provided on each of the left and the right neck-side portions 101B of the enclosure 101. The opening portions 103 on the side corresponding to the speaker unit 102R will be referred to as "opening portions 103R", and the opening portions 103 on the side corresponding to the speaker unit 102L will be referred to as "opening portions 103L". Unless distinguishing between the two is relevant, these will be referred to simply as "opening portions 103". Note that description of the shape and count of the opening portions 103 is exemplary, and is neither restricted to being circular in shape nor is restricted to a count of four.

Note that the bellows tubes 110 are provided in the neck-side portions 101B of the enclosure 101 where the opening portions 103 are provided. Accordingly, it can be said that the opening portions 103 are provided at positions corresponding to the bellows tubes 110 of the enclosure 101.

Figure 2:
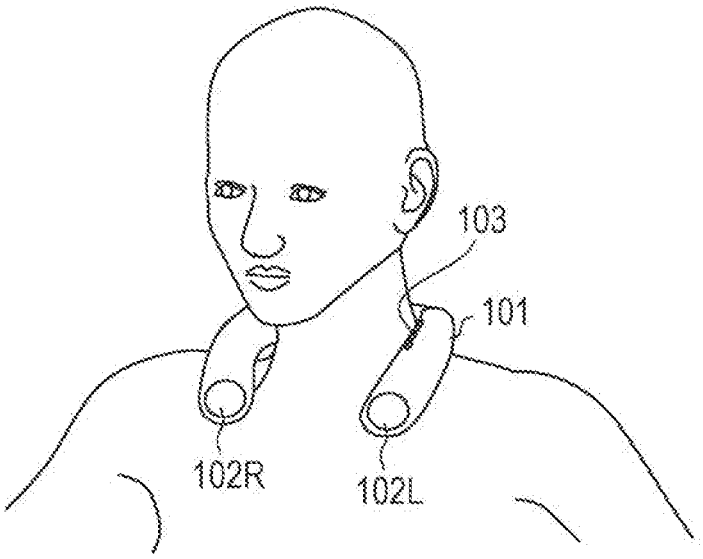
FIG. 2 is a diagram for describing an example of using the wearable speaker system.

Next, an example of using the wearable speaker system 100 will be described with reference to FIG. 2. FIG. 2 is a diagram for describing an example of using the wearable speaker system 100. The wearable speaker system 100 is worn on the neck and used with the nape portion 101A of the enclosure 101 situated behind the nape of the user, and the neck-side portions 101B of the enclosure 101 are situated from obliquely behind the neck of the user, passing both sides of the neck, to obliquely in front of both left and right sides of the neck, as illustrated in FIG. 2. Accordingly, sound output from the speaker unit 102 reaches the ears of the user well. The wearable speaker system 100 does not directly block the ears of the user, and accordingly, subjecting the user to a feeling of fatigue or the like with use like that occurring with conventional headphones can be suppressed.

Figure 3:
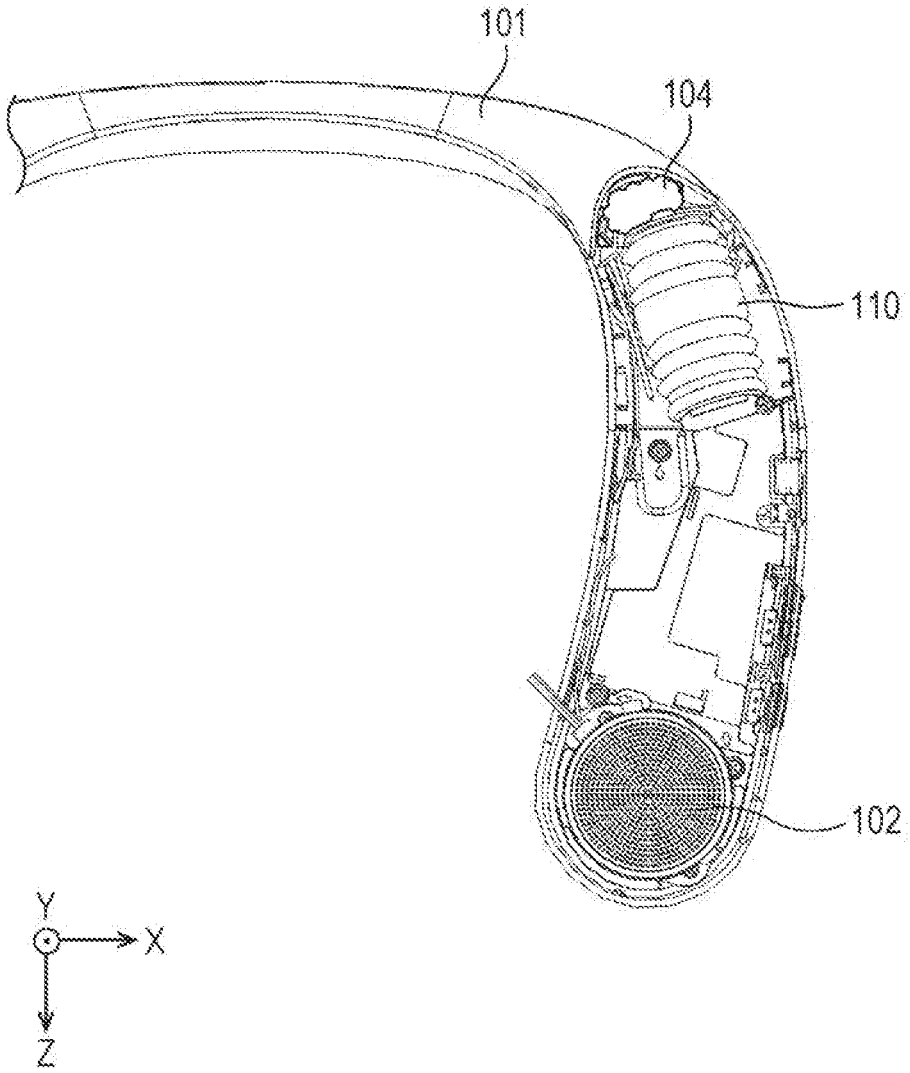
FIG. 3 is a schematic diagram for describing a structure inside an enclosure of the wearable speaker system.
Figure 4:
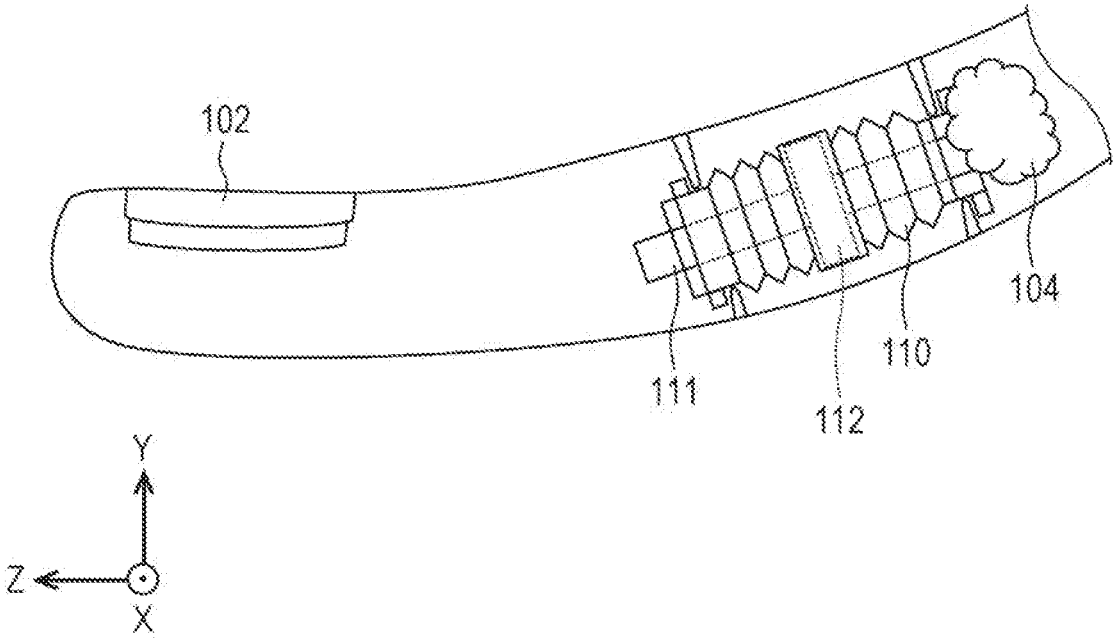
FIG. 4 is a schematic diagram for describing the structure inside the enclosure of the wearable speaker system.
Figure 5:
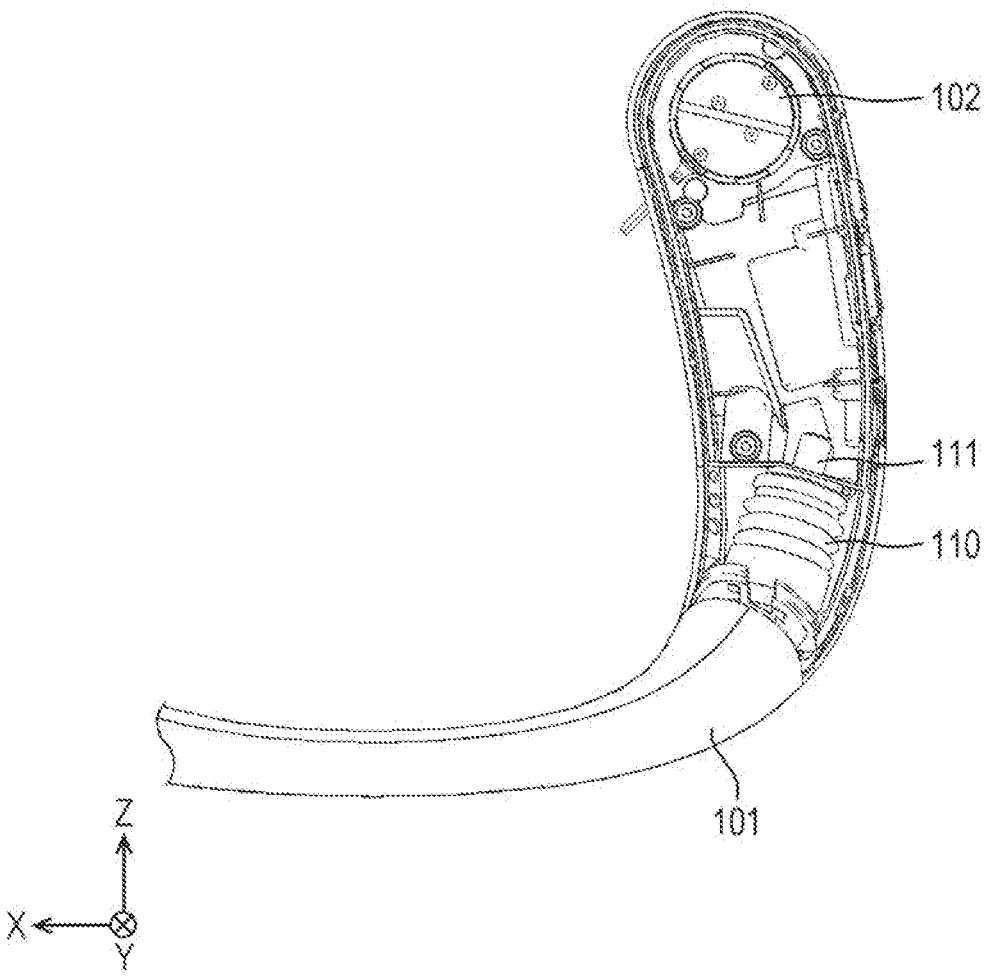
FIG. 5 is a schematic diagram for describing the structure inside the enclosure of the wearable speaker system.

Next, the structure inside the enclosure 101 will be described with reference to FIGS. 3 through 5. FIGS. 3 through 5 are schematic diagrams for describing the structure inside the enclosure 101. Note that FIGS. 3 through 5 illustrate members relevant to description of the disclosure, and do not illustrate all members included inside the enclosure 101. Note that FIG. 3 is a view of inside of the enclosure 101 from the front (Y direction), FIG. 4 is a view of inside of the enclosure 101 from the side (X direction), and FIG. 5 is a view of inside of the enclosure 101 from the back (−Y direction).

Inside the enclosure 101, a space inside the speaker unit 102 is connected to an end portion of the bellows tube 110 and an end portion of the bass reflex duct 111, as illustrated in FIGS. 3 through 5. The bass reflex duct 111 is tube-shaped, with the weight 112 attached to the middle portion thereof. The weight 112 is held approximately at the middle of the bellows tube 110.

Sound absorbing material 104 is provided at the end portion of the bass reflex duct 111 that is on the side thereof opposite from the speaker unit 102.

Note that FIGS. 3 through 5 illustrate one end portion of the wearable speaker system 100, and that the other end portion also has the same configuration.

The bellows tube 110 and the bass reflex duct 111 are disposed inside the enclosure 101 so that one end portion of the bellows tube 110 and one end portion of the bass reflex duct 111 are closer to the speaker unit 102 side and the other end portions thereof are closer to the nape portion 101A side, more specifically, the other end portions are disposed in the neck-side portion 101B at a position closer to the nape portion 101A. The bellows tube 110 is fixed at both ends by fixing portions formed on the inner face of the enclosure 101. The bellows tube 110 is a bellows-like tube, with a repetition of accordion folds formed in the side face. The repetition of accordion folds formed in the side face enables the bellows tube 110 to be extended/compressed. The approximate middle of the bellows tube 110 includes a portion where no accordion folds are formed for a length approximately the same as the length of the weight 112, so as to enable the weight 112 to be held.

Due to the space inside the speaker unit 102, and the one end portion of the bellows tube 110 and the one end portion of the bass reflex duct 111 being connected inside the enclosure 101 in this way, fluctuation in air pressure inside the speaker unit 102 is propagated to the bellows tube 110 and the bass reflex duct 111 through the inner space of the enclosure 101. This fluctuation in air pressure causes the weight 112 attached to the bass reflex duct 111 to vibrate inside the bellows tube 110. This vibration then causes the enclosure 101 to vibrate. Thus, the enclosure 101 vibrates in accordance with output from the speaker unit 102, i.e., sound output from the speaker unit 102, and accordingly the user can be made to sense vibrations corresponding to the output sound. In other words, the user can be given a feeling of presence.

Also, the end portion of the bass reflex duct 111 on the opposite side from the speaker unit 102 opens to the nape portion 101A side of the enclosure 101. This opening connects to the opening portions 103 through the space inside the enclosure 101. Accordingly, when the air pressure inside the enclosure 101 fluctuates in accordance with vibration of the diaphragm of the speaker unit 102, air pressure inside the bass reflex duct 111 fluctuates, and sound based on the output from the bass reflex duct 111 is output from the opening portions 103 via the end portion of the bass reflex duct 111. Of the fluctuation in air pressure inside the speaker unit 102 generated by the diaphragm, high-frequency components are transmitted through the bass reflex duct 111 while being attenuated a greater degree than the low-frequency components. Accordingly, output from the bass reflex duct 111 generally corresponds to the magnitude of low-frequency components. Thus, sound output from the opening portions 103 generally corresponds to the low-frequency components. This enables the user to sense bass sounds from the output of the opening portions 103.

Figure 6C:
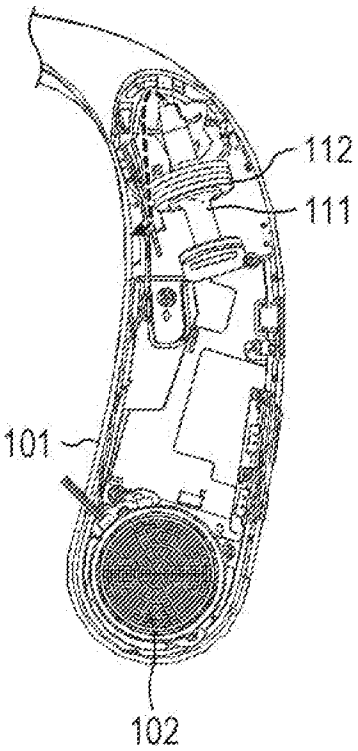
FIGS. 6A through 6C are diagrams for describing the way in which air enters and exits through opening portions via an end portion of a bass reflex duct in the wearable speaker system, where
Figure 6B:
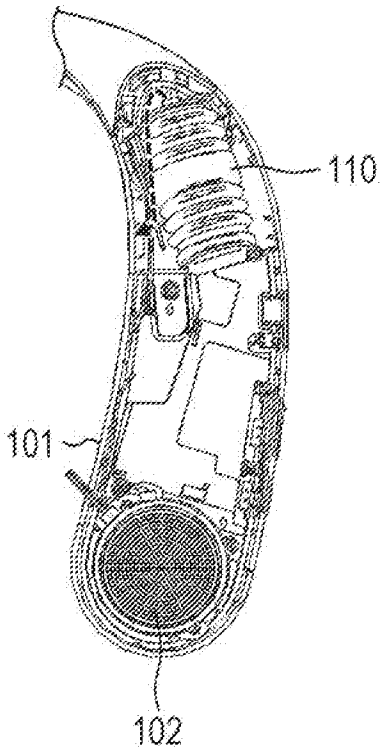
Figure 6A:
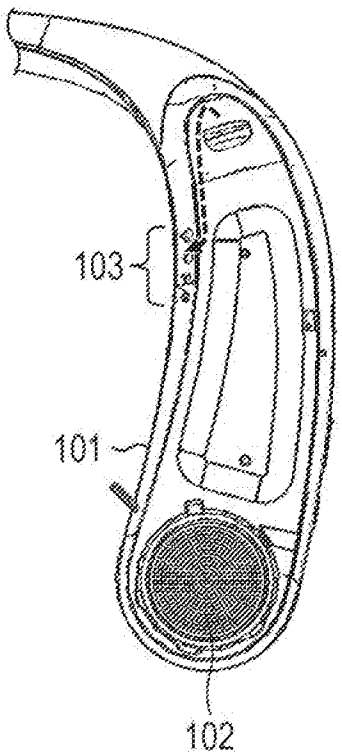

Next, the reason why wind noise accompanying output from the bass reflex duct 111 does not readily reach the user will be described with reference to FIGS. 6A through 6C. FIGS. 6A through 6C are diagrams for describing the way in which air enters and exits through opening portions 103 via the end portion of the bass reflex duct 111. FIG. 6A is a view of the outer face of the enclosure 101, FIG. 6B is a diagram illustrating the inside of the enclosure 101, and FIG. 6C is a diagram illustrating the inside of the enclosure 101 in a state where the bellows tube 110 is removed.

In the related art, the opening portions 103 are at the end portion of the bass reflex duct 111. On the other hand, in the present embodiment, the opening portions 103 and the end portion of the bass reflex duct 111 are connected via the space inside of the enclosure 101, as illustrated in FIGS. 6A through 6C. Accordingly, air exiting the end portion of the bass reflex duct 111 exits from the opening portions 103 via the space inside of the enclosure 101, as indicated by dashed-line arrows in FIGS. 6A through 6C. Thus, a situation where wind noise from the bass reflex duct 111 can be directly heard by the user, as in the related art, can be suppressed. Further, the sound absorbing material 104 is provided at the end portion of the bass reflex duct 111 in the present embodiment. Accordingly, a situation where wind noise from the bass reflex duct 111 can be heard by the user can be suppressed even further.

As described above, the wearable speaker system 100 according to the present embodiment has the enclosure 101 that is U-shaped. The wearable speaker system 100 is provided with the speaker unit 102, and the bass reflex duct 111 of which one end portion communicates with the space inside the speaker unit 102. The bass reflex duct 111 is accommodated inside the enclosure 101. The enclosure 101 is provided with the opening portions 103, and the other end portion of the bass reflex duct 111 is accommodated inside the enclosure 101.

Details of Bellows Tube 110, Bass Reflex Duct 111, and Weight 112

Next, the details of the bellows tube 110, the bass reflex duct 111, and the weight 112 will be described with reference to FIGS. 7 through 11B.

Figure 7:
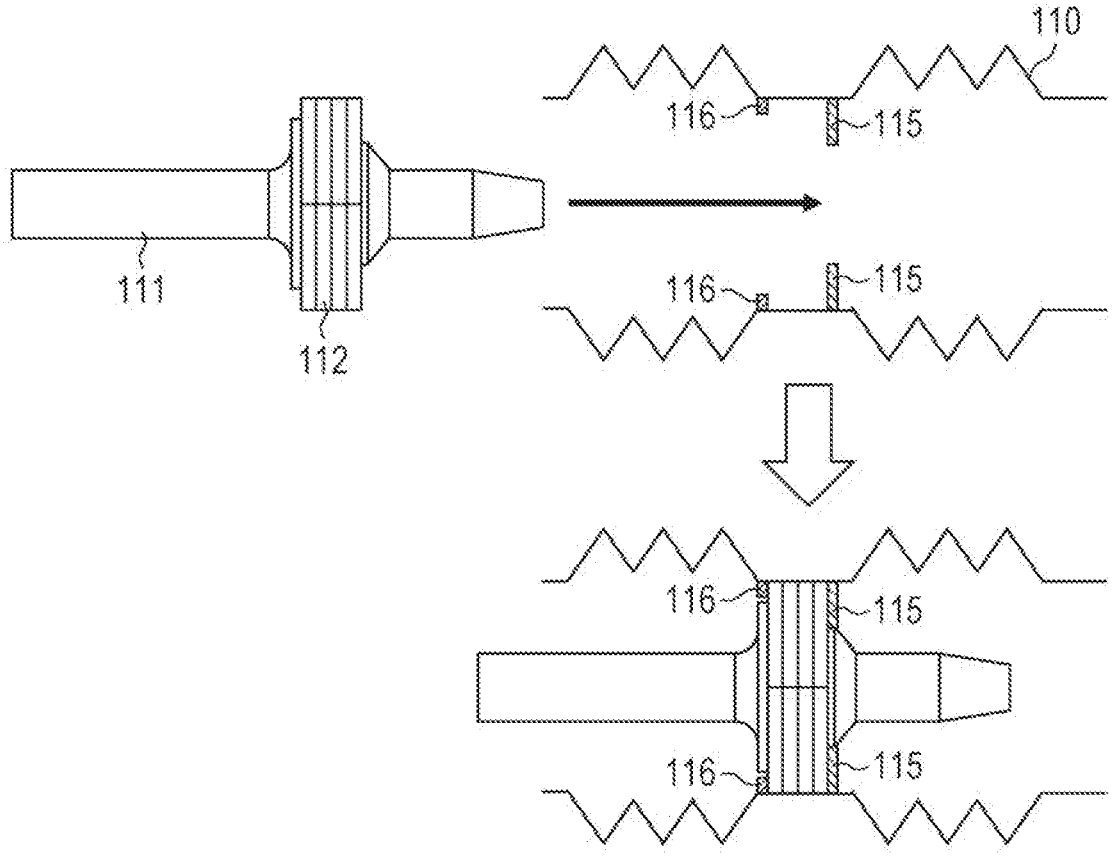
FIG. 7 is a diagram illustrating a relationship between the bass reflex duct to which a weight is attached, and the bellows tube, in the embodiment.

FIG. 7 is a diagram illustrating the relationship between the bass reflex duct 111 to which the weight 112 is attached, and the bellows tube 110. A stopper (holding portion) 115 and a stopper 116, for holding the weight 112, may be provided at the approximate middle of the inside of the bellows tube 110. The length of the stopper 115 in the direction toward the radial center of the bellows tube 110 may be greater than that of the stopper 116. Accordingly, when the bass reflex duct 111 to which the weight 112 is attached is inserted in the correct direction, i.e., in the direction from the stopper 116 toward the stopper 115, the weight 112 passes through the stopper 116 and is held in a sure manner by the stopper 115. In a held state, the weight 112 is also held by the stopper 116. The weight 112 may be held at the inside of the bellows tube 110 with the side face of the weight 112 in contact with the inner face of the bellows tube 110.

Figure 8A:
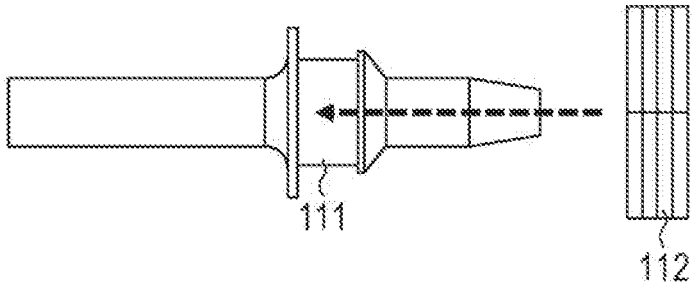
FIGS. 8A and 8B are diagrams illustrating a relationship between the bass reflex duct and weight in the embodiment, where
Figure 8B:
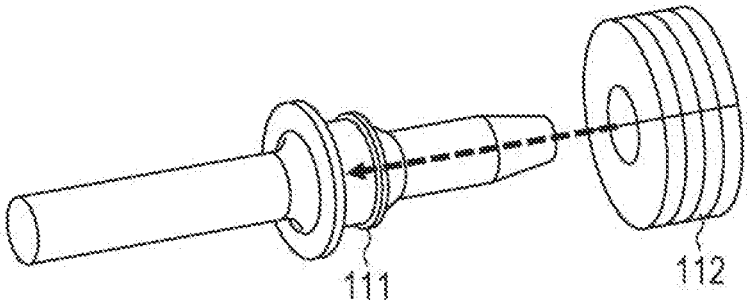

FIGS. 8A and 8B are diagrams illustrating the relationship between the bass reflex duct 111 and the weight 112, where FIG. 8A is a side view from the side, and FIG. 8B is a perspective view from an oblique direction. The weight 112 may have a cylindrical shape with an opening at the center, as illustrated in FIGS. 8A and 8B. In other words, the weight 112 may have an opening portion provided in the axial direction of the cylindrical shape. The weight 112 is held by a fixing portion of the bass reflex duct 111 by the bass reflex duct 111 being passed through the opening portion. Although the cylindrical shape is formed by combining multiple disc-shaped weights in the example illustrated in FIGS. 8A and 8B, this is not restrictive. The bass reflex duct 111 may have the fixing portion that has a larger radius than the radius of the opening portion of the weight 112, in order to hold the weight 112, and an insertion portion having a tapered shape of which the radius increases from the end portion toward the middle, as illustrated in FIGS. 8A and 8B. The radius of the tapered shape at the side closer to the fixing portion is somewhat larger than the radius of the opening of the weight 112. Thus, the weight 112 can be easily inserted into the bass reflex duct 111, and once inserted, the weight 112 can be held in a sure manner by the fixing portion and insertion portion. Note that the fixing portion and the insertion portion fix the weight 112, and accordingly these can also be collectively referred to as a "pair of fixing portions".

Figure 9A:
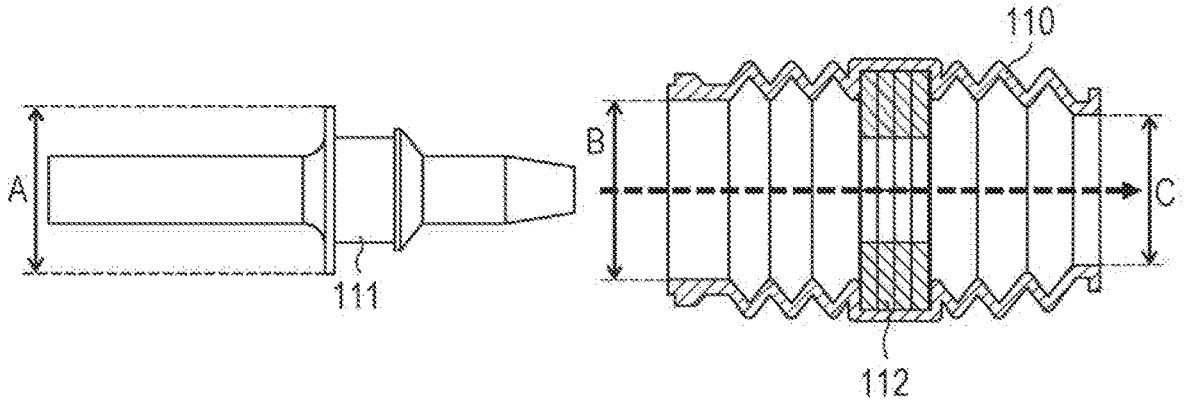
FIGS. 9A and 9B are diagrams illustrating the relationship between the bellows tube and bass reflex duct in the embodiment, where
Figure 9B:
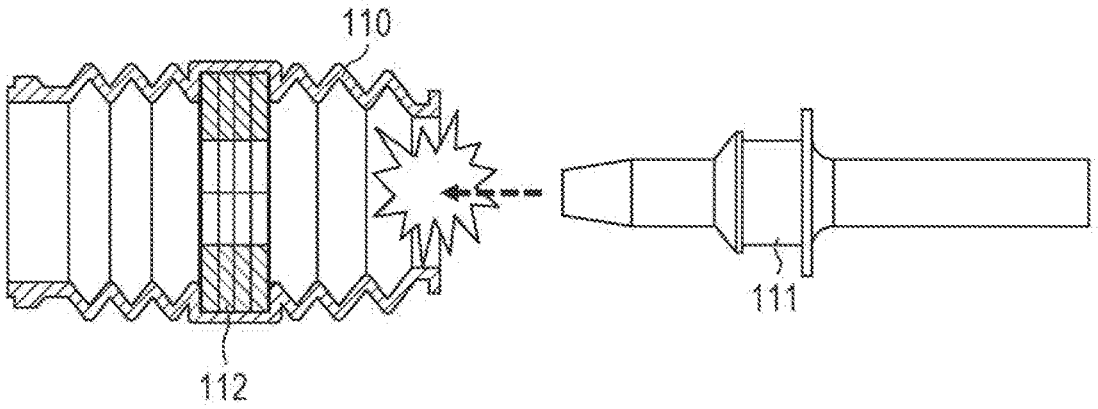
Figure 10A:
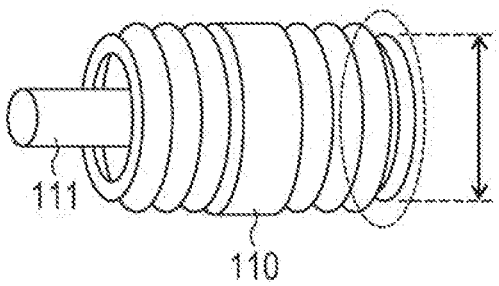
FIGS. 10A and 10B are diagrams for describing advantages due to difference in diameter of both end portions of the bellows tube in the embodiment.
Figure 10B:
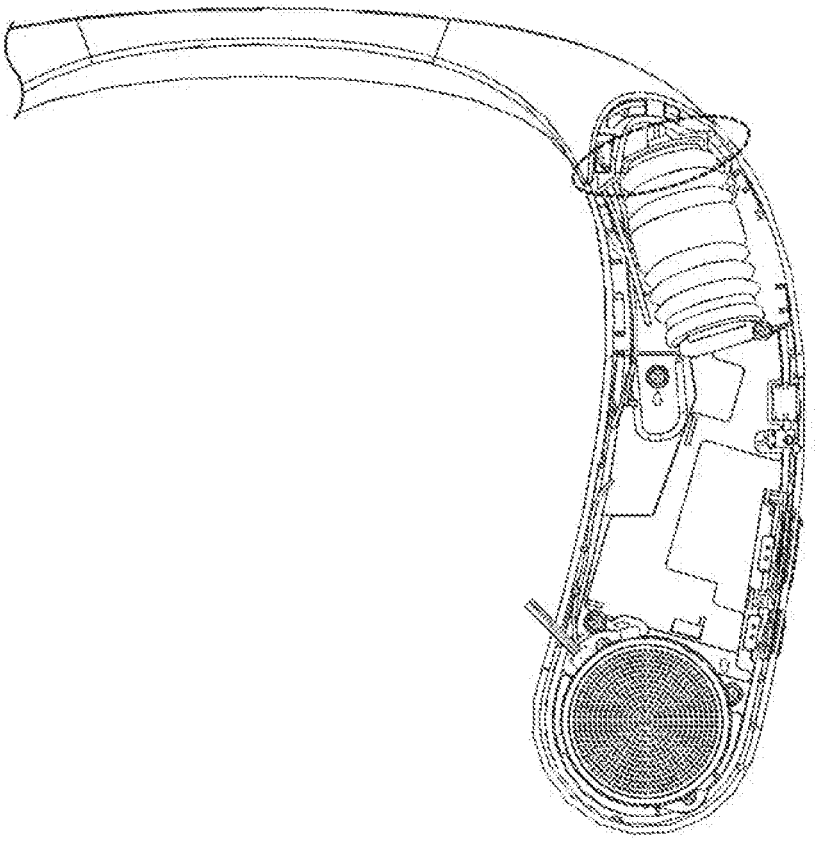

FIGS. 9A through 10B are diagrams illustrating the relationship between the bellows tube 110 and the bass reflex duct 111. FIG. 9A is a diagram illustrating an example of inserting the bass reflex duct 111 into the bellows tube 110 from the correct direction, and FIG. 9B is a diagram illustrating an example of inserting the bass reflex duct 111 into the bellows tube 110 from an incorrect direction. Also, FIGS. 10A and 10B are perspective views of the bellows tube 110 into which the bass reflex duct 111 is inserted.

As illustrated in FIGS. 9A and 9B, the length of a diameter A of the fixing portion of the bass reflex duct 111, and the respective lengths of diameters B and C of the end portions of the bellows tube 110, may all be different from each other, with the relationship thereof being B>A>C. That is to say, the diameters at both end portions of the bellows tube 110 may be different from each other, and the diameter of the fixing portion of the bass reflex duct 111 may be intermediate between the diameters of both end portions of the bellows tube 110. Accordingly, the bass reflex duct 111 can be inserted into the bellows tube 110 from the end portion where the diameter is B, but not from the end portion where the diameter is C. Thus, the bass reflex duct 111 can be kept from being inserted from an incorrect direction (see FIG. 9B).

FIGS. 10A and 10B are diagrams for describing advantages due to difference in diameters of both end portions of the bellows tube 110. Making the diameter of the end portion of the bellows tube 110 at the opposite side from the speaker unit 102 to be small is suitable, since contact with the enclosure 101 can be avoided when disposing the bellows tube 110 at a curved face portion of the enclosure 101 (see region indicated by dashed line in FIG. 10B), as illustrated in FIG. 10A. Amplitude at this end portion is small in comparison with amplitude at the middle portion, so effects on the vibrating performance of the bellows tube 110 overall is small even if the diameter of this end portion is made smaller.

Figure 11A:
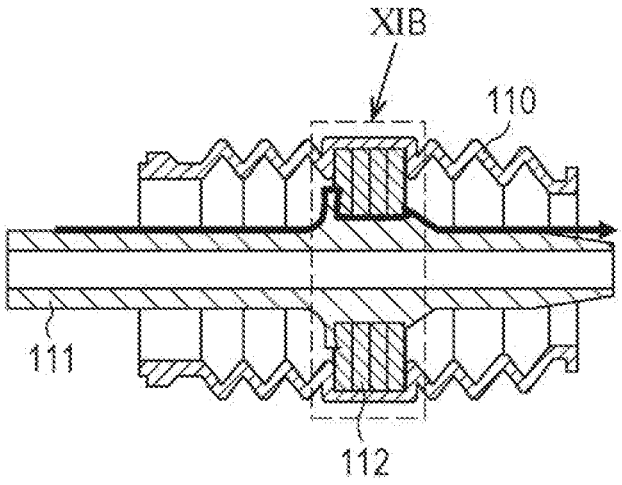
FIGS. 11A and 11B are diagrams illustrating in detail a fixing portion of the bass reflex duct in the embodiment, where
Figure 11B:
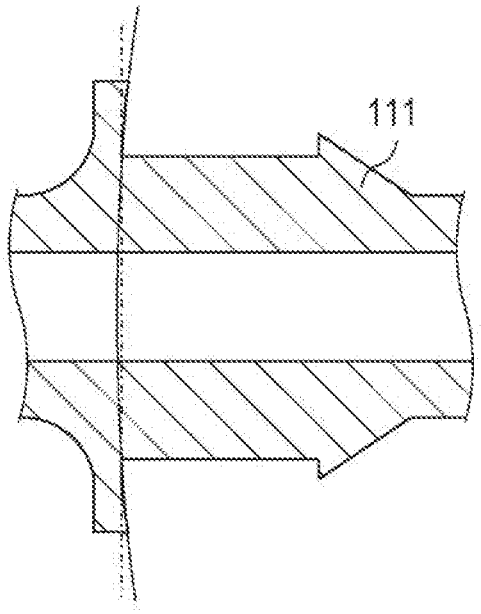

FIGS. 11A and 11B are diagrams illustrating in detail the fixing portion of the bass reflex duct 111, where FIG. 11A is a side view illustrating a state where the bass reflex duct 111 with the weight 112 attached is inserted into the bellows tube 110, and FIG. 11B is an enlarged view of a region XIB in FIG. 11A in a state where the weight 112 is removed.

The face of the fixing portion of the bass reflex duct 111 at the side where the weight 112 comes into contact may have a recessed shape that curves more toward the weight 112 side the farther on the outer side in the radial direction, as illustrated in FIG. 11B. Air moving on the basis of fluctuation in air pressure due to the diaphragm of the speaker unit 102 advances through the inside of the bellows tube 110 and attempts to advance between the bass reflex duct 111 and the weight 112, as indicated by the arrow in FIG. 11A. Imparting the recessed shape to the fixing portion of the bass reflex duct 111 as in the present embodiment increases the closeness of contact between the fixing portion of the bass reflex duct 111 and the weight 112, which makes it more difficult for air to advance between the bass reflex duct 111 and the weight 112. Accordingly, leakage of air between the bass reflex duct 111 and the weight 112 can suppressed, and the weight 112 can be made to vibrate on the basis of fluctuation in air pressure by the diaphragm of the speaker unit 102 in a sure manner.

[Summarization]

A wearable speaker system 100 provided with an enclosure 101 according to Aspect 1 of the present disclosure includes a bellows tube 110 that holds a weight member (weight 112) inside, and a speaker unit 102 where a space inside the speaker unit and a space inside the bellows tube 110 communicate with each other. The bellows tube 110 is accommodated in the enclosure 101, and both end portions of the bellows tube 110 are fixed to the enclosure 101.

According to the above configuration, the weight member held inside the bellows tube is made to vibrate by fluctuation in air pressure inside the bellows tube due to output of the speaker unit. The bellows tube itself is also extended/compressed and vibrates due to vibrations of the weight member. The wearable speaker system proper can thus be made to vibrate in accordance to the output of the speaker unit. The bellows tube is accommodated inside the enclosure, and accordingly a situation where an object comes into direct contact with the bellows tube does not occur. Thus, a situation where vibration characteristics change if some external object comes into contact with the bellows tube, as in conventional arrangements, can be avoided.

In the wearable speaker system 100 according to Aspect 2 of the present disclosure, an arrangement may be made in Aspect 1 in which the weight member (weight 112) has a cylindrical shape, and is held inside of the bellows tube 110 with a side face of the weight member and an inner face of the bellows tube 110 coming into contact.

According to the above configuration, the weight member is held inside the bellows tube with the side face of the weight member and the inner face of the bellows tube coming into contact. Accordingly, a situation where wind pressure due to fluctuation in air pressure inside the bellows tube accompanying output of the speaker unit leaks out from between the bellows tube and the weight member can be suppressed, and vibration due to fluctuation in air pressure can be generated in a sure manner.

In the wearable speaker system 100 according to Aspect 3 of the present disclosure, an arrangement may be made in Aspect 2 in which an opening portion is provided in the weight member (weight 112) in an axial direction, a duct tube (bass reflex duct 111) that is tube-shaped passes through the opening portion, one or more fixing portions are provided on a side face of the duct tube in a radial direction, and a face of the one or more fixing portions that comes into contact with the weight member has a recessed shape that curves more in a direction of contact with the weight member the farther on an outer side in the radial direction.

According to the above configuration, the airtightness at the face of contact between the weight member and the duct tube is increased, and accordingly a situation where wind pressure due to fluctuation in air pressure inside the bellows tube accompanying output of the speaker unit leaks out from between the duct tube and weight member can be suppressed, and vibration due to fluctuation in air pressure can be generated in a sure manner.

In the wearable speaker system 100 according to Aspect 4 of the present disclosure, an arrangement may be made in Aspect 3 in which the one or more fixing portions are a pair of fixing portions provided on the side face of the duct tube such that a spacing between the fixing portions in the axial direction of the duct tube (bass reflex duct 111) is identical with a length of the weight member (weight 112) in the axial direction, and one fixing portion of the pair of fixing portions has a tapered shape of which the length in the radial direction increases the further along a direction toward an other fixing portion.

According to the above configuration, the duct tube can be easily passed through the weight member, and also the weight member can be fixed to the duct tube in a sure manner.

In the wearable speaker system 100 according to Aspect 5 of the present disclosure, an arrangement may be made in any one of Aspects 2 through 4 in which a pair of holding portions that hold the weight member is provided on the inner face of the bellows tube 110 such that a spacing between the holding portions in the axial direction of the bellows tube 110 is identical with a length of the weight member (weight 112) in the axial direction, and one holding portion of the pair of holding portions has a greater length in the radial direction than an other holding portion.

According to the above configuration, the weight member can be held inside the bellows tube in a sure manner. Also, the weight member can be held at a desired position in a sure manner due to the one of the holding portions having a greater length in the radial direction than the other.

In the wearable speaker system 100 according to Aspect 6 of the present disclosure, an arrangement may be made in Aspect 4 in which diameters of the both end portions of the bellows tube 110 are different from each other, and a diameter of one fixing portion of the pair of fixing portions of the duct tube (bass reflex duct 111) is intermediate between the diameters of the both end portions.

According to the above configuration, the duct tube is insertable from only one end portion of the bellows tube, and accordingly inserting the duct tube from an incorrect direction can be avoided.

The present disclosure is not restricted to the above-described embodiments. Various modifications can be made without departing from the scope set forth in the Claims, and embodiments obtained by suitably combining technical measures disclosed in each of different embodiments are also included in the technical scope of the present disclosure. Further, new technical features can be formed by combining technical measures disclosed in the embodiments.

The present disclosure contains subject matter related to that disclosed in Japanese Priority Patent Application JP 2019-029570 filed in the Japan Patent Office on Feb. 21, 2019, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A wearable speaker system provided with an enclosure, comprising:

a bellows tube that holds a weight member inside; and a speaker unit where a space inside the speaker unit and a space inside the bellows tube communicate with each other, wherein the bellows tube is accommodated in the enclosure, and both end portions of the bellows tube are fixed to the enclosure, the weight member has a cylindrical shape, and is held inside of the bellows tube with a side face of the weight member and an inner face of the bellows tube coming into contact, an opening portion is provided in the weight member in an axial direction, and a duct tube that is tube-shaped passes through the opening portion, and one or more fixing portions for fixing the weight member are provided on a side face of the duct tube in a radial direction, wherein a pair of holding portions that hold the weight member is provided on the inner face of the bellows tube such that a spacing between the holding portions in the axial direction of the bellows tube is identical with a length of the weight member in the axial direction.

2. The wearable speaker system according to claim 1, wherein a face of the one or more fixing portions that comes into contact with the weight member has a recessed shape that curves more in a direction of contact with the weight member the farther on an outer side in the radial direction.

3. The wearable speaker system according to claim 2, wherein the one or more fixing portions are a pair of fixing portions provided on the side face of the duct tube such that a spacing between the fixing portions in the axial direction of the duct tube is identical with the length of the weight member in the axial direction, and one fixing portion of the pair of fixing portions has a tapered shape of which a length in the radial direction increases the further along a direction toward an other fixing portion.

4. The wearable speaker system according to claim 3, wherein diameters of the both end portions of the bellows tube are different from each other, and a diameter of one fixing portion of the pair of fixing portions of the duct tube is intermediate between the diameters of the both end portions.

5. The wearable speaker system according to claim 1, wherein one holding portion of the pair of holding portions has a greater length in the radial direction than an other holding portion.

* * * * *